US007798154B2

(12) United States Patent
De Laforcade

(10) Patent No.: US 7,798,154 B2
(45) Date of Patent: Sep. 21, 2010

(54) RECEPTACLE HAVING A NECK PROVIDED WITH TWO PORTIONS OF DIFFERENT DIAMETERS

(75) Inventor: Vincent De Laforcade, Rambouillet (FR)

(73) Assignee: L'Oreal (FR)

( * ) Notice: Subject to any disclaimer, the term of this patent is extended or adjusted under 35 U.S.C. 154(b) by 214 days.

(21) Appl. No.: 10/619,891

(22) Filed: Jul. 15, 2003

(65) Prior Publication Data

US 2004/0124117 A1 Jul. 1, 2004

Related U.S. Application Data

(60) Provisional application No. 60/411,383, filed on Sep. 18, 2002.

(30) Foreign Application Priority Data

Jul. 17, 2002 (FR) ..... 02 09057

(51) Int. Cl.
*A45D 24/22* (2006.01)

(52) U.S. Cl. ..... 132/113; 132/112

(58) Field of Classification Search ..... 132/112–116, 132/320, 317, 318; 215/43, 44, 228; 222/1; 401/126, 127, 129, 202, 269, 207
See application file for complete search history.

(56) References Cited

U.S. PATENT DOCUMENTS 1,866,770 A * 7/1932 Hilgenberg ..... 215/44
2,270,529 A * 1/1942 Kirschenbaum ..... 132/125
3,046,593 A * 7/1962 Goldman ..... 401/202
3,106,742 A * 10/1963 Schultz et. al. ..... 401/202
3,121,906 A * 2/1964 Hulsh ..... 401/202
3,179,972 A * 4/1965 Fillmore ..... 401/202
3,393,963 A 7/1968 Duqueroie
3,410,645 A * 11/1968 Schwartzman ..... 401/135
4,341,319 A * 7/1982 Ogasawara ..... 215/307
4,555,194 A * 11/1985 Hammond ..... 401/206
4,881,558 A * 11/1989 Hollenberg et al. ..... 132/112
5,316,399 A * 5/1994 Joulia ..... 401/127
5,326,185 A * 7/1994 Dornbusch et al. ..... 401/88
5,513,763 A * 5/1996 Adams et al. ..... 215/254
6,260,557 B1 7/2001 Yarbrough
6,270,277 B1 * 8/2001 Ogino et al. ..... 401/269

(Continued)

FOREIGN PATENT DOCUMENTS

DE 100 54 564 A1 5/2001

(Continued)

OTHER PUBLICATIONS

WO 02/1822 Feb. 1822 Lutch "Screw-type cap constisting of plastic" Mar. 7, 202.*

(Continued)

*Primary Examiner*—Robyn Doan
(74) *Attorney, Agent, or Firm*—Lerner, David, Littenberg, Krumholz & Mentlik, LLP

(57) ABSTRACT

The present invention provides a receptacle comprising:
a body; and
a neck, comprising:
a first portion having a first diameter, and having first fixing means; and
a second portion situated between the body of the receptacle and the first portion, said second portion having a second diameter greater than the first diameter, and having second fixing means.

29 Claims, 5 Drawing Sheets

U.S. PATENT DOCUMENTS

| | | | | |
|---|---|---|---|---|
| 6,457,476 | B1 * | 10/2002 | Elmer et al. | 132/114 |
| 6,523,720 | B1 * | 2/2003 | Robbins, III | 222/1 |
| 7,059,333 | B2 | 6/2006 | Duqueroie et al. | |

FOREIGN PATENT DOCUMENTS

| | | | |
|---|---|---|---|
| DE | 199 54 450 | A1 | 5/2001 |
| EP | 1142504 | A1 | 10/2001 |
| FR | 72.513 | A1 | 4/1960 |
| GB | 1 531 783 | A1 | 11/1978 |
| WO | WO-99/30592 | | 6/1999 |

OTHER PUBLICATIONS

Office Action dated Dec. 14, 2007, for EP Patent Application No. 03291739.5 corresponding to this application.

* cited by examiner

RECEPTACLE HAVING A NECK PROVIDED WITH TWO PORTIONS OF DIFFERENT DIAMETERS

CROSS REFERENCE TO RELATED APPLICATIONS

This application claims the benefit of U.S. Provisional Application No. 60/411,383 filed Sep. 18, 2002.

BACKGROUND OF THE INVENTION

The present invention relates to packaging and dispenser devices, in particular receptacles for containing cosmetics and applicators for fixing on such receptacles.

The term "cosmetic" is used herein to designate any "cosmetic product" as defined in EEC Council Directive 93/35/EEC of Jun. 14, 1993.

At present, there exist hair-coloring kits including a flask containing an oxidizer, the flask having a threaded neck of a certain diameter. Prior to use, the flask is closed by a cap having a corresponding diameter. The cap is manufactured using a mold having a large number of recesses at a cost that is relatively high.

Accessories, such as applicator combs, having a plurality of dispenser orifices are made available together with the flasks.

Sometimes, accessories cannot be made in such a manner as to be capable of being screwed onto the threaded neck of an existing flask because of their nature or for manufacturing reasons. It is then necessary to make new flasks and new caps, which means that new molds need to be made. In addition, existing accessories can no longer be used on the new flasks unless adapters are provided. This leads to extra costs and, in addition, can lead to problems of leakage or an ugly appearance.

SUMMARY OF THE INVENTION

The present invention seeks to address these drawbacks.

In one embodiment of the present invention, a receptacle is provided comprising:

a body and a neck. The neck comprises a first portion that has a first diameter and a first fixing means, and a second portion located between the body of the receptacle and the first portion. The second portion has a second diameter greater than the first diameter and a second fixing means. The neck may have a shoulder connecting the first portion to the second portion. The shoulder may be a plane annular surface extending outside and perpendicular to the neck. This annular surface may be used, as described in greater detail below, to cooperate with an accessory so as to obtain sealing. The receptacle may be made of a plastic material.

In one aspect of the present invention, the first portion or the second portion has a thread. In a further aspect, the first portion and the second portion both have threads, and still further, they have threads that allow for turning in the same direction.

In another aspect of the present invention, the first portion or the second portion has at least one snap-fastening shape in relief. The snap-fastening shape in relief may be an annular bead.

It is then possible to fix accessories of different kinds on the first and second portions of such a receptacle, e.g. by screw fastening or snap-fastening, depending on the nature of the fixing means.

By way of example, the first portion may be configured to receive existing accessories that have the same diameter as the neck of existing flasks. The second portion may be configured, for example, to receive a newly-developed accessory that has an assembly skirt with a relatively larger diameter. Thus, the invention makes it possible to continue to be able to use existing caps, thus avoiding the need to make new molds for caps. The invention also makes it possible to use a greater variety of accessories in association with a given receptacle, and without having to use adapters.

At least one of the first and second portions may include a thread enabling an accessory to be screwed onto the neck of the receptacle. Such a thread may be made in various ways and may comprise, for example, a one-start thread or a multiple-start thread.

In a variant, at least one of the first or second portions include a snap-fastening shape in relief comprising an annular bead, for example, enabling an accessory to be fixed onto the neck of the receptacle by snap-fastening.

Another aspect of the present invention allows the first portion to have a first inside diameter. The second portion has a second inside diameter that is larger than the first inside diameter.

In another aspect of the present invention, the neck has an inside shoulder that connects the first portion to the second portion.

In another aspect of the present invention a kit is provided. The kit comprising a receptacle with a first portion having a body and a neck including first portion with a first diameter and a first fixing means and a second portion located between the body and the first portion with a second diameter larger than the first diameter and a second fixing means. The kit also includes at least one accessory configured to be fixed on the neck.

The accessory may be configured to cooperate with the second portion, for example, by screw fastening.

The accessory may have an assembly skirt configured to cooperate with the second portion, for example, by screw fastening. The assembly skirt may include a sealing surface that abuts a shoulder which connects the first and second portions of the receptacle together. This sealing surface may be defined, for example, by an annular bead. Sealing between the accessory and the receptacle can be provided on the outside of the neck, thus, in a further aspect, the accessory may be made without a sealing lip that comes to bear against the inside of the neck of the receptacle. This makes it possible to use a manufacturing method for making the accessory that is incompatible with the presence of such a sealing lip.

In one aspect of the present invention, the accessory is an applicator, in particular an applicator comb. The applicator may have teeth. At least one of the teeth may include at least one dispenser orifice which may be at a distance from the free end of that tooth. The dispenser orifice may be oriented in such a manner as to limit the risk of dispensing the substance other than between the teeth. Such a configuration is particularly useful with an applicator comb since it makes it possible to avoid dispensing the substance directly onto the scalp, and it can make it easier to treat locks of hair.

In another aspect of the present invention, the applicator has at least one row of teeth with end teeth located at the ends of the row. The end teeth do not have any dispenser orifice opening other than the ones that open into the gap between the teeth. The end teeth may not have any dispenser orifices at all.

In another aspect of the present invention, at least one tooth in the row located between the end teeth may have two dispenser orifices on the exterior of the tooth on opposite sides in a direction parallel to the row. In a further aspect of the present invention, each tooth located between the end teeth has at least one dispenser orifice. The applicator may be made by molding a plastics material, and in one aspect, at least one of the teeth may include at least one groove extending from its free end to a dispenser orifice formed in the tooth.

In one aspect of the present invention, the applicator has at least six teeth, each provided with at least one dispenser orifice. Preferably, each tooth has two dispenser orifices opening in opposite directions. All of the teeth of the applicator may be of the same length.

When at least one of the first and second portions of the neck has a thread, the kit may include at least one accessory configured for screwing onto the thread. Also, when at least one of the first and second portions of the neck includes at least one snap-fastening shape in relief, the kit may include at least one accessory arranged with at least one complementary snap-fastening shape in relief configured to cooperate with the snap-fastening shape of the receptacle.

In another aspect of the present invention, the kit includes at least two accessories of different kinds. In particular, one accessory will cooperate with the first portion and the other accessory will cooperate with the second portion of the neck. For example, one of the accessories may be a cap and the other may be an applicator.

In one aspect, the kit may have an accessory configured for cooperating with the first portion of the neck. The accessory may also be a dispenser endpiece or a receptacle.

The receptacle may be filled with a cosmetic. The cosmetic may be, for example, a substance for coloring the hair.

In another embodiment of the present invention, an applicator is provided that cooperates with the neck of a receptacle. The applicator includes an assembly skirt arranged to cooperate with the receptacle. The assembly skirt includes an annular bead made on an inside surface of the skirt at a distance from the free end. The annular bead makes it possible to obtain sealing. In a further aspect of the present invention, an applicator fastens onto the neck of the receptacle by screw fastening.

In another aspect of the present invention, a method is provided for manufacturing a kit comprising a receptacle as defined above and at least one accessory configured for fixing on the neck, in particular an applicator comb. The method comprises the following steps:

making the receptacle, filling the receptacle with a cosmetic, fixing a cap on the first portion of the neck, and packaging the receptacle carrying the cap with an applicator configured to be capable of being fixed on the second portion of the neck.

In another embodiment of the present invention, a receptacle comprising: a body and a neck. The neck comprising a first portion having a first inside diameter and including a first fixing means and a second portion situated between the body of the receptacle and the first portion. The second portion has a second inside diameter greater than the first inside diameter, and has a second fixing means.

In another of its aspects, the present invention provides a receptacle comprising: a body and a neck, comprising: a first portion having a first diameter and including a first fixing means and a second portion located between the body of the receptacle and the first portion. The second portion has a second diameter greater than the first diameter, and has a second fixing means. The first portion and the second portion are connected by an inside shoulder.

In still yet another of its aspects, the present invention provides a receptacle comprising: a body and a neck, comprising: a first portion having a first diameter and including a first thread and a second portion located between the body of the receptacle and the first portion. The second portion has a second diameter greater than the first diameter and includes a second thread. The first and second threads enable screw fastening to be performed by turning in the same direction.

In another embodiment of the present invention, a receptacle is provided which includes a body and a neck. The neck includes a first portion having a first diameter and at least one of a first thread or a first snap-fastening shape in relief, and a second portion located between the body of the receptacle and the first portion. The second portion has a second diameter greater than the first diameter and at least one of a second thread or a second snap-fastening shape in relief.

In another of its aspects, the present invention provides a kit comprising:

a receptacle comprising:

a body, a neck and at least two accessories of different kinds. The neck includes a first portion having a first diameter and a first fixing means and a second portion located between the body of the receptacle and the first portion. The second portion has a second diameter greater than the first diameter and a second fixing means. In a further aspect, the accessories are selected from an applicator, an endpiece, a cap, and a second receptacle.

In still another embodiment of the present invention, a kit comprising:

a receptacle comprising: a body and a neck, and at least two accessories. The neck includes a first portion having a first diameter and a first fixing means and a second portion located between the body of the receptacle and the first portion. The second portion has a second diameter greater than the first inside diameter and a second fixing means. The accessories cooperate with the first portion and the second portion, respectively. In one aspect of the present invention, the accessories are selected from an applicator, an endpiece, a cap and a second receptacle.

BRIEF DESCRIPTION OF THE DRAWINGS

The invention can be better understood on reading the following detailed description of non-limiting embodiments and on examining the accompanying drawings, in which.

DETAILED DESCRIPTION

Figure 1:
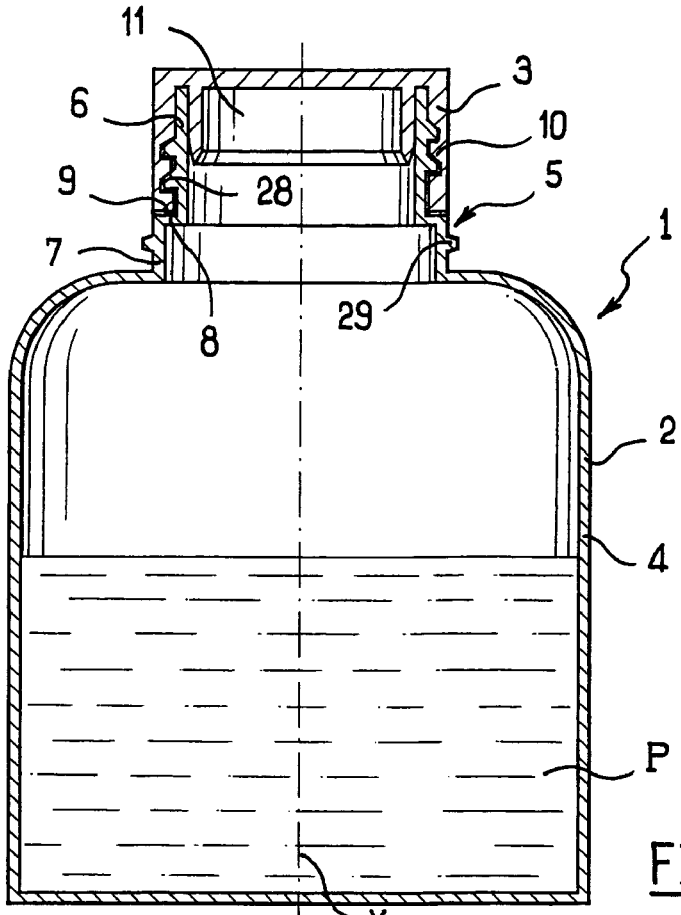
FIG. 1 is a diagrammatic axial view showing a kit in accordance with a first embodiment of the present invention.

FIG. 1 shows a kit 1 of the invention comprising a receptacle 2 and a closing cap 3. In the example described, the receptacle 2 is made of a plastics material. The receptacle 2 comprises a body 4 containing a cosmetic, for example a substance P for coloring the hair, and a neck 5 about axis X.

At its top end, the neck 5 has a first portion 6 and at its bottom end it has a second portion 7. The second portion is located between the body 4 and the first portion 6 and has a diameter greater than the diameter of the first portion 6. The first portion may have a thread 28 on its outside surface and the second portion 7 may also have a thread 29 on its outside surface. The threads 28 and 29 may be made in various ways, for example, a one-start thread or a multiple-start thread.

The first and second threaded portions 6 and 7 are connected together by a shoulder 8 defining a plane annular surface 9 which extends outwards from the neck 5 perpendicularly to the axis X.

The cap 3 has a tubular skirt provided with an inside thread 10. The inside thread 10 enables cap 3 to be screwed onto the threaded first portion 6 of the neck 5, as shown in FIG. 1. Sealing between the neck 5 and the cap 3 may be implemented by means of a sealing lip 11 of the cap 3. Sealing lip 11 presses against the radially inner surface of the threaded first portion 6, which surface is circularly cylindrical about the axis X.

The neck of the receptacle may have first and second fixing means of the same type, as shown in FIG. 1, for example, threads. The threads enable screw fastening to be performed by turning. The threads may be turned in the same direction, or in different directions. Also first and second fixing means may be of different types. For example, the first fixing means being constituted by a thread, and the second fixing means being constituted by snap-fastening means, or vice versa. At least one of the first and second fixing means may also be configured, for example, so as to enable snap-fastening to take place after performing a screw fastening operation. The snap-fastening may have the function, for example, of making unscrewing more difficult, or merely of informing the user that the accessory has been screwed on far enough.

Figure 2:
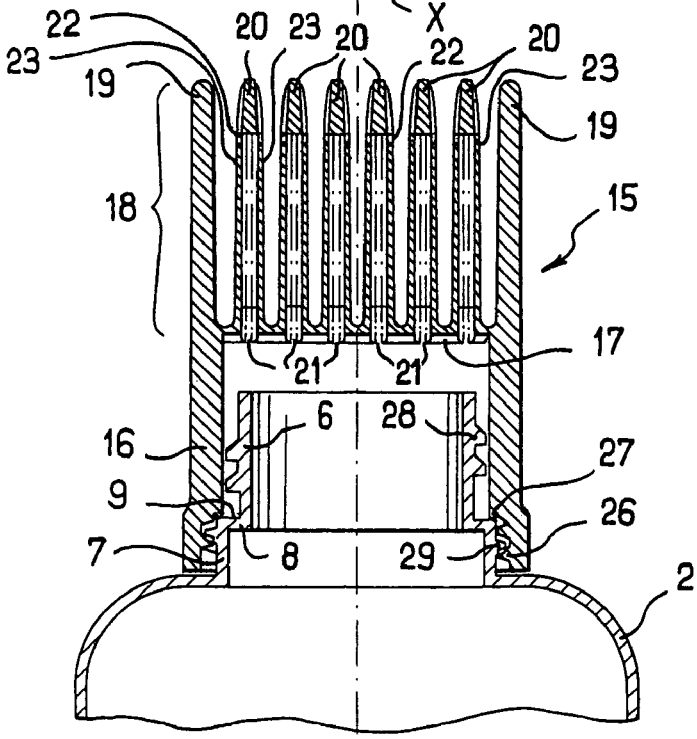
FIG. 2 is a fragmentary axial view showing a kit of the invention comprising the receptacle of FIG. 1.

To apply the substance P to the hair, the user unscrews the cap 3 and screws an applicator comb 15 onto the threaded portion 7, as shown in FIG. 2. This applicator 15 is made as a single molding of plastics material. At its bottom end, the applicator 15 includes an assembly skirt 16, and about halfway up applicator 15 includes a transverse wall 17 having a row of teeth 18 extending therefrom.

This row 18 has two end teeth 19 with six intermediate or "active" teeth 20 being interposed between them. The teeth 20 may be of the same length as the end teeth 19.

As shown in the example of FIG. 2, the row 18 extends substantially along the entire diameter of the transverse wall 17. The six intermediate teeth 20 extend over a length that is greater than the diameter of the threaded first portion 6.

Figure 3:
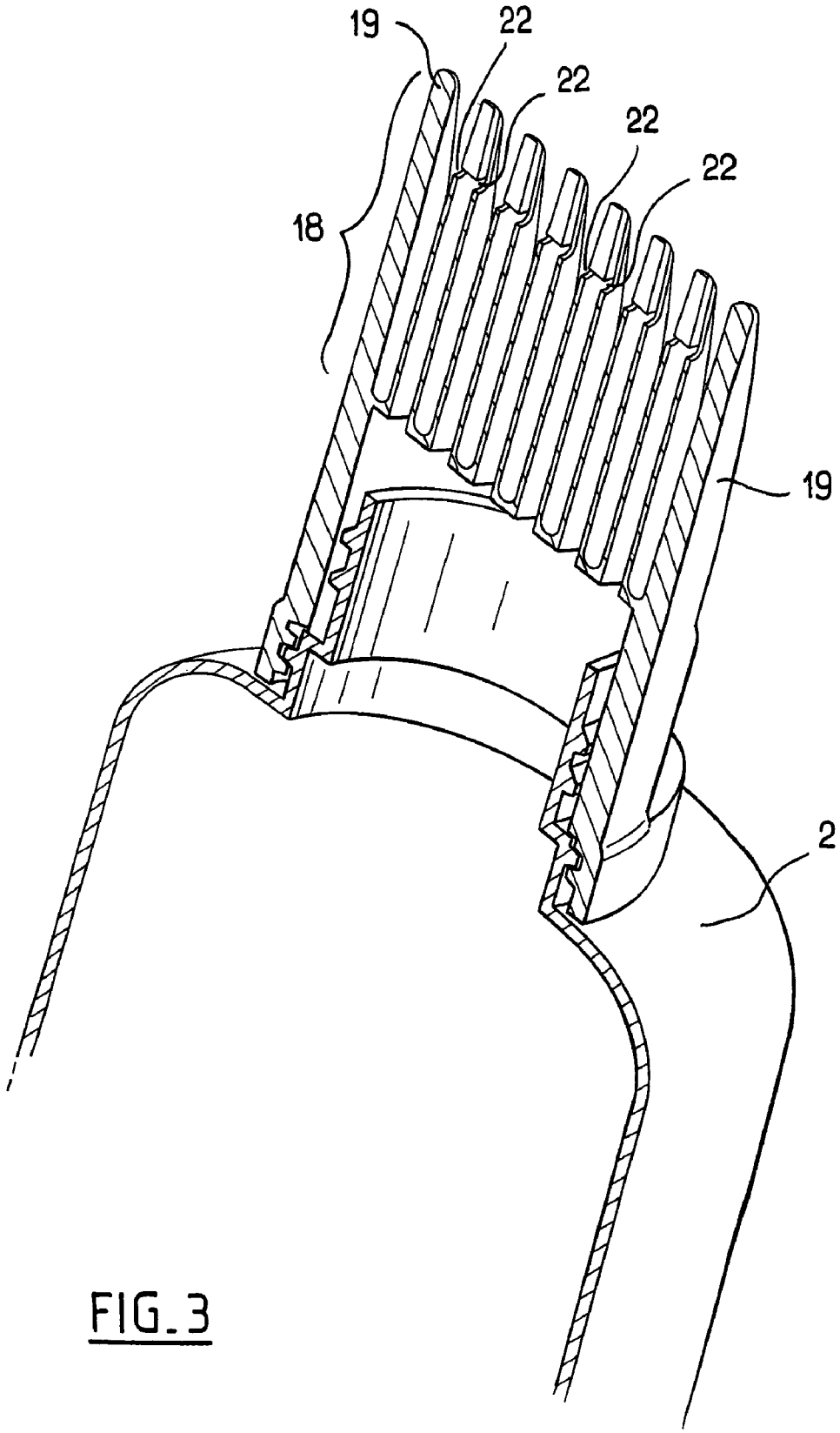
FIG. 3 is a fragmentary axial section view in another perspective of the FIG. 2 kit.
Figure 4:
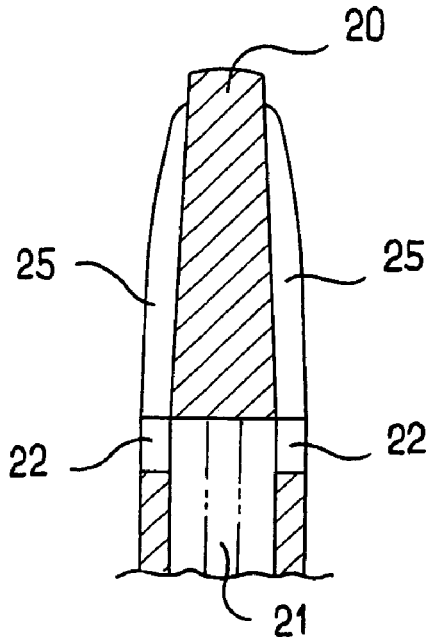
FIG. 4 is a fragmentary axial view of the top portion of one of the teeth in the FIG. 2 kit.

Each intermediate tooth 20 may have an internal channel 21 whose bottom end opens out through the transverse wall 17. The internal channel 21 communicates with the outside via two dispenser orifices 22. As shown in FIGS. 2 through 4, each tooth 20 has two substantially parallel side faces 23 perpendicular to the axis of the row 18. The two dispenser orifices 22 open out respectively in said two side faces 23 at a non-zero distance from the free end of the tooth.

Grooves 25 extend in each face 23 of the tooth 20 from the dispenser orifice 22 present in said face to the free end of the tooth. The dispenser orifices 22 may be made by means of two mold portions that are movable relative to each other parallel to the longitudinal axis of the teeth 20. The mold portions come into contact at the level of the dispenser orifices 22. The groove enables the tooth to be unmolded by separating two mold portions in a direction parallel to the axis of the tooth. This can make it easier to manufacture the applicator.

The end teeth 19 may not have any dispenser orifices. Thus, the dispenser orifices 22 of the teeth 20 open out into a gap lying between two teeth. This makes it possible to limit the risk of substance being squirted out from the row 18.

In its bottom portion, the assembly skirt 16 has an inside thread 26 enabling it to be screwed onto the threaded second portion 7 of the neck 5.

The assembly skirt 16 also has an annular bead 27 made on the inside surface of the skirt 16. The annular bead 27 is located immediately above the inside thread 26 in the example shown. This annular bead 27 is designed to abut the annular surface 9 of the neck 5, as shown in FIG. 2. This will provide sealing between the neck 5 and the applicator 15. Because sealing is provided on the outside of the neck 5, it is possible to avoid the need to provide a sealing lip that bears against the inside surface of the threaded portion 6. This makes it possible to provide the applicator 15 with active teeth 20 over a distance that is greater than the diameter of the threaded first portion 6. Also, it is possible to provide a relatively large number of teeth, for example, six in the example shown.

In order to treat the hair, the user moves the applicator 15 through the hair with the substance P flowing out into the channels 21 leading to the dispenser orifices 22.

The receptacle 2 may be associated with accessories other than a cap 3 and an applicator comb 15.

Figure 5:
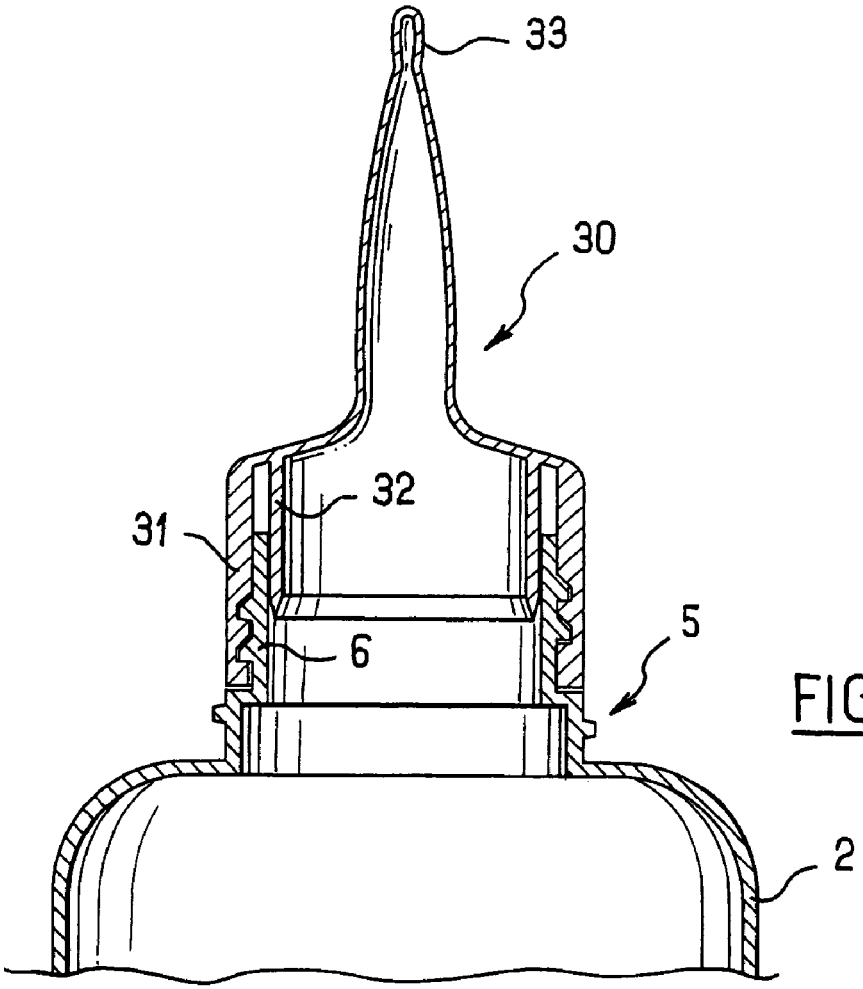
FIG. 5 is a fragmentary axial view of another example of a kit in accordance with the present invention.

By way of example, FIG. 5 shows an accessory 30 constituted by an endpiece having a single dispenser orifice. Accessory 30 may be suitable for being screwed onto the neck 5 of the receptacle 2. This accessory 30 comprises an assembly skirt 31 with an inside thread which may be screwed onto the threaded first portion 6 of the neck 5. The accessory 30 also comprises an internal sealing skirt 32 that may abut the inside surface of the threaded first portion 6. At its top end, the accessory 30 is provided with a snap-off portion 33 which the user detaches at the moment of use.

Figure 6:
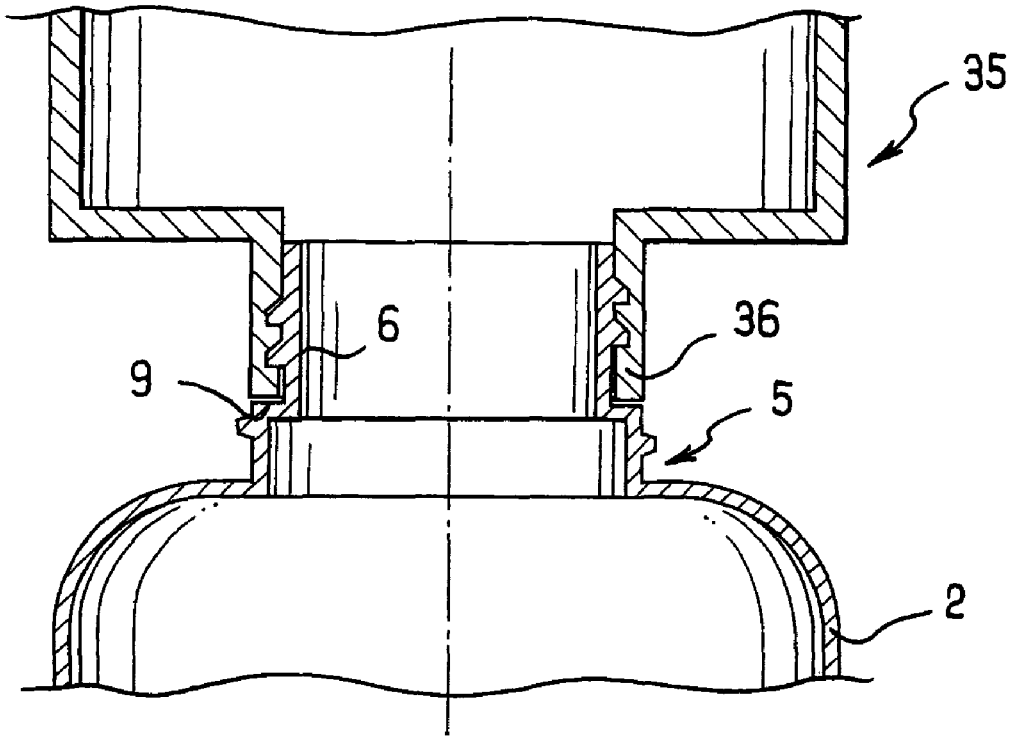
FIG. 6 is a fragmentary axial view of a kit constituting another aspect of the present invention.

It is also possible to use an accessory, for example, such as a second receptacle 35, as shown in FIG. 6. This allows one to perform extemporaneous mixing of two substances, in particular, an oxidizer and a coloring agent, prior to application on the hair. The second receptacle 35 has a neck 36 with an inside thread configured for screwing onto the threaded first portion of the neck 5. Sealing can be obtained, for example, by pressing the end of the neck 36 against the annular surface 9. Annular surface 9 may be provided, where appropriate, with sealing means such as a deformable gasket.

Figure 7:
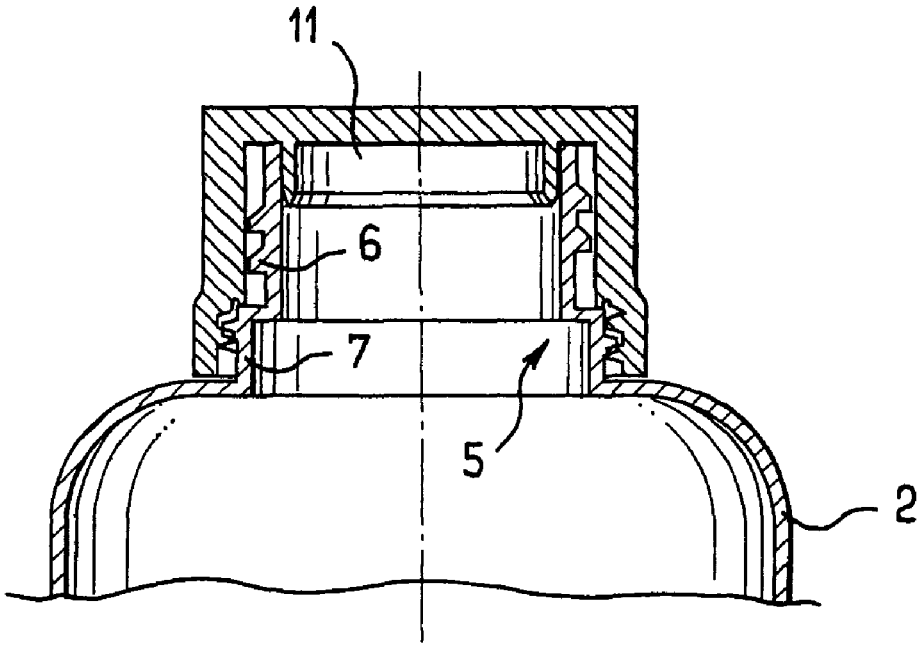
FIG. 7 is a fragmentary axial view showing another aspect of the kit of FIG. 1.

In FIG. 7, the cap 3, described with reference to FIG. 1, may also be configured so as to be suitable for screwing onto the threaded second portion 7 of the neck 5. The accessories can be fixed by being screwed onto the neck 5 of the receptacle.

Figure 8:
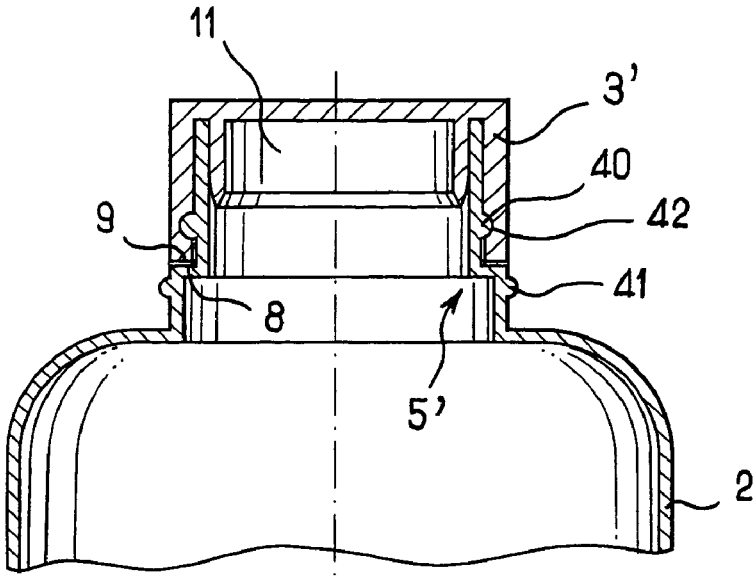
FIG. 8 is a fragmentary axial view showing still another aspect of the present invention.
Figure 9:
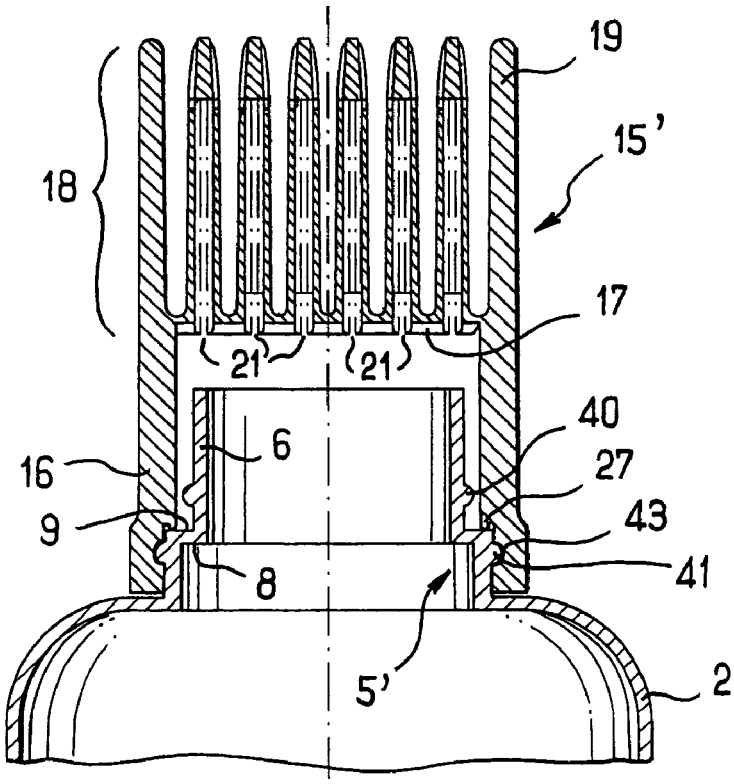
FIG. 9 is a fragmentary axial view showing yet another aspect of the present invention.

It is within the scope of the present invention to provide other fixing means on the outside surfaces of the portions 6 and 7 of the neck 5. For example, FIGS. 8 and 9 show a receptacle provided with a neck 5' that differs from the above-described neck 5 in that the threads of the first and second portions 6 and 7 are replaced by annular beads 40 and 41, respectively. The accessories such as a cap 3' and an applicator 15', for example, are then each provided with a respective annular groove 42, 43 suitable for co-operating with the corresponding annular bead 40 or 41 by snap-fastening.

Naturally, the invention is not limited to the examples described above. In particular, the applicator comb 15 may be replaced by any other type of applicator, for example, having teeth without any dispenser orifices or with the dispenser orifices being made at the base of the teeth.

Throughout the description, including in the claims, the term "comprising a" should be understood as being synonymous with "comprising at least one" unless specified to the contrary.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A kit, comprising:

a first receptacle comprising:

a body containing a cosmetic comprising a first substance for coloring hair; and a neck providing an opening into said body, said neck including a first portion having a first inside diameter and a first fixing means, a second portion located between said body of said receptacle and said first portion, and a shoulder connecting said first portion to said second portion, said second portion having a second inside diameter and a second fixing means, wherein said second inside diameter is greater than said first inside diameter; and at least one first accessory including a first applicator having teeth and an assembly skirt, said assembly skirt including:

a free end;

skirt fixing means cooperable with said second fixing means on said neck of said receptacle for removably fixing said first accessory onto said neck; and an annular bead integrally formed on an inside surface of said assembly skirt, said annular bead including a sealing surface that abuts said shoulder when said first accessory is fixed to said neck, wherein said skirt fixing means is situated between and spaced from both said free end and said annular bead.

2. The kit according to claim 1, wherein at least one of said teeth includes at least one dispenser orifice.

3. The kit according to claim 2, wherein said at least one dispenser orifice is spaced from a free end of said at least one of said teeth.

4. The kit according to claim 3, wherein said at least one dispenser orifice substantially limits the cosmetic from dispensing other than between said teeth.

5. The kit according to claim 2, wherein said at least one of said teeth includes a groove extending from a free end of said at least one of said teeth to said at least one dispenser orifice.

6. The kit according to claim 1, wherein said first applicator includes at least one row of teeth including a pair of end teeth located at the respective ends of said at least one row of teeth, said pair of end teeth having dispenser orifices which face others of said at least one row of teeth.

7. The kit according to claim 6, wherein at least one tooth between said pair of end teeth includes a plurality of said dispenser orifices on the exterior of said at least one tooth such that said plurality of dispenser orifices are parallel to said at least one row of teeth.

8. The kit according to claim 7, wherein said plurality of dispenser orifices are located on opposite sides of said at least one tooth.

9. The kit according to claim 7, wherein all of said teeth between said pair of end teeth include at least one dispenser orifice.

10. The kit according to claim 1, wherein said first applicator includes at least one row of teeth including a pair of end teeth located at the respective ends of said at least one row of teeth, said pair of end teeth having no dispenser orifices.

11. The kit according to claim 1, wherein said first applicator includes at least six teeth, each of said teeth including at least one dispenser orifice.

12. The kit according to claim 1, wherein said teeth are of substantially the same length.

13. The kit according to claim 1, wherein said first applicator is made by molding.

14. The kit according to claim 1, wherein at least one of said first fixing means or said second fixing means includes a thread, said kit having at least one accessory adapted for screwing onto said thread.

15. The kit according to claim 1, wherein at least one of said first fixing means or said second fixing means includes at least one snap-fastening member, said kit including at least one accessory having at least one complementary snap-fastening member adapted to cooperate with said at least one snap-fastening member.

16. The kit according to claim 1, further including a second accessory of a different kind than said first accessory.

17. The kit according to claim 16, wherein second accessory is adapted for cooperating with said first portion of said neck and a second of portion.

18. The kit according to claim 16, wherein said second accessory is selected from the group consisting of a cap, an endpiece, a second applicator, and a second receptacle.

19. The kit according to claim 16, wherein said second accessory is selected from the group consisting of an endpiece, a second applicator and a second receptacle.

20. The kit according to claim 19, wherein said endpiece has a single dispenser orifice.

21. The kit according to claim 1, wherein said shoulder comprises a planar annular surface on an outside surface of said neck, said shoulder being perpendicular to said neck.

22. The kit according to claim 1, wherein both said first fixing means and said second fixing means include threads.

23. The kit according to claim 22, wherein said threads enable screw fastening by turning in a same direction.

24. The kit according to claim 1, wherein said first receptacle comprises a plastic material.

25. The kit according to claim 1, wherein said first accessory is configured for removably fixing onto said neck of said receptacle by fastening only on said second fixing means.

26. The kit according to claim 1, wherein said first accessory does not include a sealing lip that abuts an inside of said neck of said receptacle.

27. The kit according to claim 1, further comprising a second receptacle containing a second substance different than said cosmetic, said second receptacle including third fixing means cooperable with said first portion of said neck.

28. The kit according to claim 27, wherein one of said first substance and said second substance is a coloring agent and the other of said first substance and said second substance is an oxidizer.

29. The kit according to claim 1, wherein said annular bead is a continuation of a cylindrical inside surface of said first accessory.

* * * * *

UNITED STATES PATENT AND TRADEMARK OFFICE

CERTIFICATE OF CORRECTION

PATENT NO. : 7,798,154 B2
APPLICATION NO. : 10/619891
DATED : September 21, 2010
INVENTOR(S) : Vincent De Laforcade It is certified that error appears in the above-identified patent and that said Letters Patent is hereby corrected as shown below:

Title page, item [57]
Delete the abstract and substitute the attached abstract as shown on the attached page.

Column 8, line 27, after "wherein" insert --said--.
Column 8, line 29, delete "and a second of portion".

Signed and Sealed this
Fourteenth Day of February, 2012

David J. Kappos

David J. Kappos
*Director of the United States Patent and Trademark Office*

ABSTRACT

The present invention provides a receptacle including a body and a neck. The neck includes a first portion having a first diameter and a first fixing means. The neck also includes a second portion located between the body and the first portion. The second portion has a second diameter that is greater than the first diameter and a second fixing means.